US012612558B2

(12) United States Patent
Kapaun et al.

(10) Patent No.: US 12,612,558 B2
(45) Date of Patent: Apr. 28, 2026

(54) PROCESS AND APPARATUS FOR RECOVERING POLYMER OIL FROM DRAG STREAM

(71) Applicant: UOP LLC, Des Plaines, IL (US)

(72) Inventors: Nickolas Kapaun, Chicago, IL (US); Dennis Robert Ladendorf, Carpentersville, IL (US)

(73) Assignee: UOP LLC, Rosemont, IL (US)

( * ) Notice: Subject to any disclaimer, the term of this patent is extended or adjusted under 35 U.S.C. 154(b) by 267 days.

(21) Appl. No.: 18/582,342

(22) Filed: Feb. 20, 2024

(65) Prior Publication Data

US 2024/0343980 A1 Oct. 17, 2024

Related U.S. Application Data

(60) Provisional application No. 63/459,728, filed on Apr. 17, 2023.

(51) Int. Cl.

| | |
|---|---|
| ***C10G 1/10*** | (2006.01) |
| ***C10G 1/00*** | (2006.01) |
| ***C10G 9/04*** | (2006.01) |

(52) U.S. Cl.

CPC ..... *C10G 1/10* (2013.01); *C10G 1/002* (2013.01); *C10G 9/04* (2013.01); *C10G 2300/1003* (2013.01); *C10G 2300/4081* (2013.01)

(58) Field of Classification Search

CPC . C10G 1/10; C10G 1/002; C10G 9/04; C10G 2300/1003; C10G 2300/4081; C10G 1/02

See application file for complete search history.

(56) References Cited

U.S. PATENT DOCUMENTS

| | | | | |
|---|---|---|---|---|
| 2020/0165526 | A1* | 5/2020 | Bertrand | F23G 5/027 |
| 2022/0402006 | A1* | 12/2022 | Wu | C10B 49/22 |
| 2023/0117658 | A1* | 4/2023 | Bitting | C10G 1/10 208/14 |

FOREIGN PATENT DOCUMENTS

| | | | | |
|---|---|---|---|---|
| WO | WO-2018014922 | A1 * | 1/2018 | C10B 53/07 |
| WO | WO-2023117650 | A1 * | 6/2023 | C10B 53/07 |

* cited by examiner

*Primary Examiner* — Ali Z Fadhel

(74) *Attorney, Agent, or Firm* — Paschall & Associates, LLC; James C. Paschall

(57) ABSTRACT

Process and apparatus for recovering a product stream from a waste plastic feedstock and reducing the endpoint of the product stream is provided. A polymer oil is produced as a product stream by pyrolyzing the waste plastic feedstock in a pyrolysis reactor to produce a pyrolysis vapor and passing the pyrolysis vapor to a condenser. A drag stream from the pyrolysis reactor is further pyrolyzed to convert the polymer oil to pyrolysis oil which is vaporized under pyrolysis conditions to vaporous pyrolysis oil and dry char. Vaporous pyrolysis oil is recovered to enhance conversion and fed to a condenser using a liquid jet ejector.

19 Claims, 1 Drawing Sheet

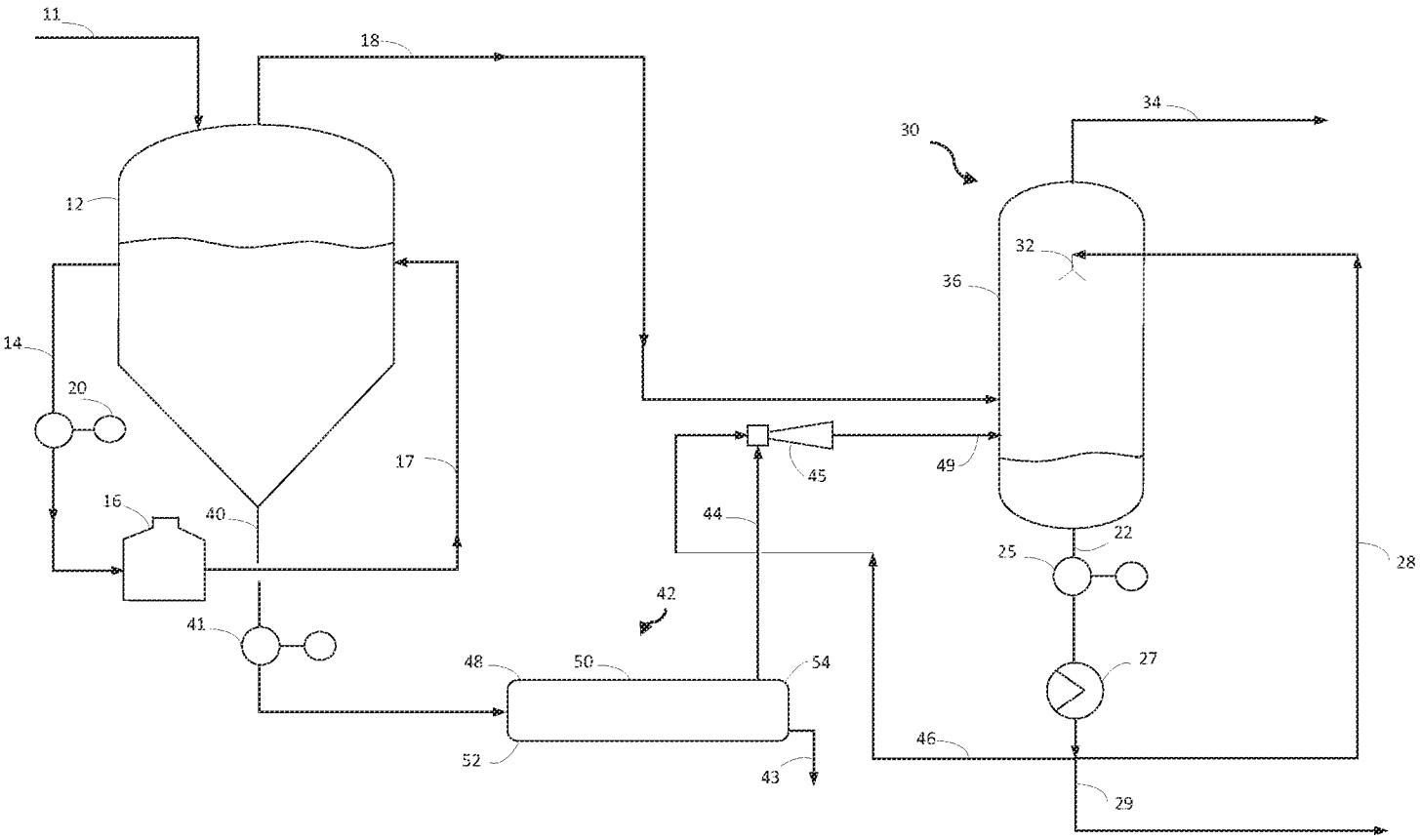
11
12
14
20
16
40
41
17
18
48
52
50
42
54
43
44
45
49
36
30
32
34
25
22
27
46
29
28

PROCESS AND APPARATUS FOR RECOVERING POLYMER OIL FROM DRAG STREAM

FIELD

The field relates to recovering polymer oil from waste plastic feedstocks by converting waste plastic into hydrocarbon products. More particularly the field relates to a process for converting waste plastics into hydrocarbon products by pyrolysis.

BACKGROUND

Past plastic recycling paradigms can be described as mechanical recycling. Mechanical recycling entails sorting, washing, and melting recyclable plastic articles to molten plastic materials to be remolded into a new clean article. The melt and remolding paradigm have encountered several limitations. Additionally, recyclable plastic articles must be properly cleaned to remove non-plastic residues before melting and remolding which also adds to the expense of the process. Mechanically recovered plastic also has a limit on the percentage used in newly made plastics.

A paradigm shift has enabled the chemical industry to rapidly respond with new chemical recycling processes for recycling waste plastics. The new paradigm is to chemically convert the recyclable plastics to liquids in a pyrolysis process operated at about 350° C. to about 600° C. The liquids can be refined in a refinery to fuels, petrochemicals and even monomers that can be re-polymerized to make virgin plastic resins. The pyrolysis process still requires separation of collected non-plastic materials from plastic materials fed to the process. Another requirement in plastic pyrolysis is to convert pyrolysis effluent into useful hydrocarbon products and polymer grade oil. Of late, it has been determined that polymer oil recovered from waste plastic pyrolysis process often cannot directly be routed to a steam cracking unit for further separation and recovery without undergoing pre-processing.

Thus, the primary target is to manage polymer oil derived from a waste plastic pyrolysis process. Polymer oil is to be used as a feed to a naphtha steam cracking unit, where the hydrocarbon chains are cracked into light olefins such as ethylene and propylene, which are subsequently used to produce polymers like polyethylene and polypropylene.

In a conventional plastic pyrolysis unit, molten plastic is heated in a continuously stirred tank reactor to produce hydrocarbon products by thermal cracking of the polymer chains.

A vapor product consisting of non-condensable hydrocarbon gases, and a condensable hydrocarbon mixture such as polymer oil having a boiling point range of approximately about 35° C. (95° F.) to about 595° C. (1100° F.) and small amounts of entrained non-volatile droplets of liquid are drawn from the top of the reactor for condensing and recovery.

A byproduct of the pyrolysis process is a solid referred to as char generated from pyrolysis of inorganic solids, cellulose, polyester terephthalate, organic matter, plastic additives, and other non-polyolefin impurities present in the feed. Char is also produced via undesirable side-reactions that take place during pyrolysis of polyolefins, so while increased feed impurities will produce more char, even a feed free of non-polyolefin impurities will still produce some char.

It would be useful to have a process and apparatus for managing char produced from pyrolysis of plastic.

SUMMARY OF INVENTION

We have discovered a process for recovering a product stream from a waste plastic feedstock comprising pyrolyzing the waste plastic feedstock in a pyrolysis reactor to produce a PYROLYSIS VAPOR STREAM AND A DRAG STREAM COMPRISING CHAR IN POLYMER OIL. THE DRAG STREAM IS pyrolyzed to convert the polymer oil to pyrolysis oil which is vaporized under pyrolysis conditions to vaporous pyrolysis oil and dry char. The drag stream may be pyrolyzed in a rotary calciner. The vaporous pyrolysis oil from the drag stream may be condensed in a condenser. The vaporous pyrolysis oils from the drag stream may be fed into the condenser with a jet ejector.

We have also discovered an apparatus comprising a pyrolysis reactor for producing a pyrolysis vapor stream and a drag stream. A drag pyrolysis reactor is in downstream communication with a drag line extending from a bottom of the pyrolysis reactor and a condenser is in downstream communication with the drag pyrolysis reactor.

These and other features, aspects, and advantages of the present disclosure are further explained by the following detailed description, drawing and appended claims.

BRIEF DESCRIPTION OF THE DRAWINGS

The various embodiments will hereinafter be described in conjunction with the FIGURE, wherein like numerals denote like elements. The FIGURE is a schematic drawing of a process and apparatus of the present disclosure.

Skilled artisans will appreciate that elements in the FIGURE are illustrated for simplicity and clarity and have not necessarily been drawn to scale. For example, the dimensions of some of the elements in the FIGURE may be exaggerated relative to other elements to help to improve understanding of various embodiments of the present disclosure. Also, common but well-understood elements that are useful or necessary in a commercially feasible embodiment may not be depicted to facilitate a less obstructed view of these various embodiments of the present disclosure.

DEFINITIONS

The term "communication" means that fluid flow is operatively permitted between enumerated components, which may be characterized as "fluid communication".

The term "downstream communication" means that at least a portion of fluid flowing to the subject in downstream communication may operatively flow from the object with which it fluidly communicates.

The term "upstream communication" means that at least a portion of the fluid flowing from the subject in upstream communication may operatively flow to the object with which it fluidly communicates.

The term "direct communication" means that fluid flow from the upstream component enters the downstream component without passing through any other intervening vessel.

The term "indirect communication" means that fluid flow from the upstream component enters the downstream component after passing through an intervening vessel.

The term "Cx" is to be understood to refer to molecules having the number of carbon atoms represented by the subscript "x". Similarly, the term "Cx+" refers to molecules that contain more than or equal to x and preferably x and more carbon atoms. The term "Cx−" refers to molecules with less than or equal to x and preferably x and less carbon atoms.

DETAILED DESCRIPTION

We have discovered an improved process for managing char that is produced from pyrolyzing a waste plastic feedstock. The char cannot vaporize and leave with a pyrolysis vapor product, so it will build up in the unconverted, melted polymer liquid in the pyrolysis reactor over time and cause plugging of the process unless it is removed from the reactor. To remove char from the reactor, a drag stream may be drained from the bottom of the reactor. This drag stream comprises char particles dispersed in polymer oil that have not yet been converted into pyrolysis product. The drag stream is not a desirable feedstock for petrochemical or refinery applications and burning it as fuel or discarding it would represent a loss of product, since this polymer oil would continue to react and convert to pyrolysis oil if it remained in the reactor.

In the improved process and apparatus, the drag stream is pyrolyzed into a vaporous pyrolysis stream and dry char. Pyrolysis of the drag stream may be conducted in a drag pyrolysis reactor such as a rotary calciner. The drag vaporous pyrolysis stream may be condensed along with the vaporous pyrolysis stream from the pyrolysis reactor. The dried char may be disposed of or burned for heating value.

The disclosed process and apparatus reprocess the drag stream to convert the remaining polymer oil in the drag stream into a pyrolysis product and leave behind only the solid char particles. This increases the unit's total yield of high-value pyrolysis product by an estimated 10% and minimizes the amount of low-value drag byproduct by an estimated 60% by weight.

In an embodiment, the plastic feed stream is processed with minimal sorting and cleaning at a materials recycling facility (MRF). The plastic feed stream may be obtained from the MRF instead of being sent to a landfill. As shown in the FIGURE, the waste plastic feedstock coming in from external sources is passed through a charge line 11 to the pyrolysis reactor 12 for pyrolysis in the pyrolysis reactor. The plastic feed may be compressed plastic material obtained from a separated bale of compacted plastic articles. The plastic articles can be chopped into plastic chips or particles which may be fed to the pyrolysis reactor 12. An auger or an elevated hopper may be used to transport the plastic feed as whole articles or as chips into the pyrolysis reactor 12. Plastic articles or chips may be heated to above the plastic melting point into a melt and injected or augured into the pyrolysis reactor 12. An auger may operate in such a way as to move whole plastic articles into the pyrolysis reactor and simultaneously melt the plastic articles in the auger by friction or by indirect heat exchange into a melt which enters the pyrolysis reactor in a molten state.

The pyrolysis reactor 12 for pyrolysis of plastic melt or chips may be a continuous stirred tank reactor. The pyrolysis reactor 12 may employ an agitator. In the pyrolysis reactor 12, the plastic feed stream in line 11 is heated to a temperature that pyrolyzes the plastic feed stream to a pyrolysis product. By pyrolysis, the chemical bonds of the polymer chains are broken to produce shorter hydrocarbon chains by depolymerization and volatilization reactions until the resultant molecules are light enough to vaporize at the conditions in the pyrolysis reactor 12.

As shown in the embodiment of the FIGURE, the waste plastic feedstock is passed in a plastic feed stream from an external source via line 11 into the pyrolysis reactor 12 which may be considered a polymer pyrolysis reactor. The waste plastic feedstock will be introduced with nitrogen or other inert gas to keep air from entering with the feed. The plastic feed stream melts and enters into a liquid phase of polymer oil in the reactor 12. An unreacted polymer oil stream in line 14 is withdrawn from the pyrolysis reactor 12 in line 14 and pumped by pump 20 to a fired heater 16 in which the polymer oil is heated. The heated polymer oil is returned in line 17 back to the pyrolysis reactor 12 for additional pyrolysis. This withdrawal and return of polymer oil to the pyrolysis reactor 12 is performed with sufficient velocity to provide a stirring effect in the pyrolysis reactor 12 which can supplant the need for a stirrer or agitator necessary for a continuously stirred tank reactor.

In the polymer pyrolysis reactor 12, the plastic feed stream is heated to a temperature of about 300° C. (572° F.) to about 500° C. (932° F.) or preferably about 350° C. (662° F.) to about 450° C. (842° F.) and to a pressure of about 7 kPa (gauge) (1 psig) to about 150 kPa (gauge) (22 psig) in an inert environment such as nitrogen.

At these pyrolysis conditions, the waste plastic feedstock pyrolyzes to smaller molecules which then vaporize at pyrolysis conditions. A pyrolysis vapor stream is discharged from a top of the pyrolysis reactor in line 18 and is fed to a condenser 30. Some of the polymer oil present in the reactor 12 converts to char and collects in the bottom of the reactor 12. The char is an undesirable by-product of the pyrolysis process. To remove char from the pyrolysis reactor 12 a drag stream comprising char in a polymer oil is taken from a bottom of the reactor in a drag line 40 extending from a bottom of the pyrolysis reactor 12. The bottom of the pyrolysis reactor 12 may be conical or frustoconical in shape to facilitate collection and withdrawal of the char. Some of the unreacted polymer oil is inevitably taken in the drag stream in line 40 which helps to transport the char. A pump 41 transports the drag stream in line 40. In an aspect, the polymer oil in the drag stream in line 40 may comprise C31+ hydrocarbons.

The drag stream comprises unreacted polymer oil and char. The polymer oil has yet to be pyrolyzed or converted to pyrolysis oil. If disposed of, the polymer oil would represent a product loss. Hence, it is proposed to subject the polymer oil to further pyrolysis to increase conversion efficiency in the process. Accordingly, the solid char is transported in the unconverted polymer oil in line 40 to an additional, drag pyrolysis reactor 42.

Accordingly, the hot drag stream in the drag line 40 may be further heated in a drag pyrolysis reactor 42 to further pyrolyze or convert polymer oil while drying the char. The pyrolyzed polymer oil is converted to smaller hydrocarbon molecules which vaporize at pyrolysis conditions to provide drag pyrolysis vapor. At these conditions, the solid char is dried of polymer oil and becomes dried char. In the drag pyrolysis reactor 42, the drag stream is heated to about 450° C. (842° F.) to about 700° C. (1292° F.).

The drag pyrolysis reactor 42 may comprise an inlet end 52 and an outlet end 54. The inlet end 52 receives the drag stream. The inlet end 52 may be connected to the drag line 40. A drag pyrolysis vapor stream may be discharged from a top of the drag pyrolysis reactor 42 in a drag pyrolysis vapor line 44 extending from a top of the drag pyrolysis reactor 42 and a dried char stream that may be discharged from the outlet end 54 of the drag pyrolysis reactor 42 in a char line 43. The char line 43 may extend from a bottom of the drag pyrolysis reactor 42. The atmosphere in the drag pyrolysis reactor 42 is inert, which is preferably an oxygen-free, nitrogen atmosphere, but may be any other inert non-oxidizing atmosphere or under vacuum. Pressure in the drag pyrolysis reactor 42 may be around atmospheric pressure of about-5 kPa (g) (−0.6 psig) to about 5 kPa (0.6 psig) (g) and preferably about-3 kPa (g) (−0.36 psig) to about 3 kPa (g) (0.36 psig). Pyrolysis conditions may be maintained for a sufficient residence time to produce a dried char product and a drag pyrolysis vapor stream at the outlet end 54 of the rotary calciner 48. Dried char may be disposed of, used as fuel, or further processed for other purposes.

The drag pyrolysis reactor 42 can comprise a rotary calciner 48 that has an elongated, horizontal shell 50 which may have a greater length than its height. The rotary calciner 48 may comprise the inlet end 52 which receives the drag stream and may be connected to the drag line 40. The shell 50 may have a generally cylindrical configuration. The rotary calciner 48 may comprise a rotary kiln, a fired kiln, a fired rotary kiln or other substantially similar equipment. All fired kilns may be directly or indirectly fired.

The shell 50 may be slightly inclined downwardly from the inlet end 52 to the outlet end 54. Circumferential rotation of the shell 50 and gravity operate to move the drag stream from the inlet end 52 to the outlet end 54 enabling exposure of the liquid polymer oil on surfaces of the char to pyrolysis and faster vaporization of pyrolyzed material from the char. An inner surface of the shell 50 may include baffles that propel material toward the outlet end 54. The rotary calciner 48 may have rotating equipment that mechanically moves the drag stream from the inlet end 52 to the outlet end 54 under heating.

The drag pyrolysis reactor 42 operates to crack polymer to lighter hydrocarbons such as ethylene and propylene which vaporize and may go up in the drag pyrolysis vapor line 44. The drag pyrolysis vapor line 44 transports the drag pyrolysis vapor stream to the condenser 30. The condenser 30 may be in downstream communication with the outlet end 54 of the drag pyrolysis reactor 42.

In the condenser 30, the pyrolysis vapor streams are cooled and condensed to a liquid pyrolysis oil stream. The pyrolysis vapor stream in line 18 from the pyrolysis reactor 12 and the drag pyrolysis vapor stream in line 44 drag may be fed to a bottom half of the condenser 30. The drag pyrolysis vapor stream in line 44 may be fed to the condenser 30 below the pyrolysis vapor stream in line 18. The condenser 30 may be in downstream communication with an overhead line 18 extending from an overhead of the pyrolysis reactor 12 and an overhead line 44 extending from the overhead of the drag pyrolysis reactor 42.

The condenser 30 may be a quench column 36 that comprises a spray distributor 32 in a top thereof above the inlets for the pyrolysis vapor streams in lines 18 and 44. A portion of the liquid pyrolysis oil stream taken in line 28 from a bottom of the condenser 30 is cooled and sprayed from the distributor onto the incoming pyrolysis vapor streams to cool and liquefy them to liquid pyrolysis oil. A pyrolysis vapor stream comprising non-condensable gases is separated from the pyrolysis liquid stream in the condenser 30. A vapor product stream is recovered in a condenser overhead line 34 extending from an overhead of the condenser 30.

A pyrolysis oil stream is taken in a condenser bottoms line 22 extending from a bottom of the condenser 30, pumped in a pump 25 and cooled in a cooler 27. The cooled pyrolysis oil stream is split between a spray stream in line 28, a slip stream in line 46 and a product liquid pyrolysis oil stream in line 29. In an aspect, the liquid pyrolysis oil stream in line 29 may comprise C1-C30 hydrocarbons. The spray stream in line 28 is recycled to the top of the condenser 30 in line 28 to be sprayed onto the incoming pyrolysis vapor streams. The sprayed pyrolysis oil contacts the incoming pyrolysis vapor streams to cool and condense them to provide liquid pyrolysis oil.

The drag pyrolysis vapor stream in line 44 is at around atmospheric pressure, so cannot flow back into the condenser 30, which operates at elevated pressures of about 7 kPa (g) (1 psig) to about 150 kPa (gauge) (22 psig). The vapors are also very hot, greater than 300° C., and prone to fouling, so cannot be handled using conventional mechanically driven compressors. Accordingly, the drag pyrolysis vapor stream in line 44 is routed to a liquid jet ejector 45. The slip stream in line 46 is also routed to the liquid jet ejector 45 as the motive liquid. The momentum of a pumped slip stream in line 46 provides the work of compression for the liquid jet ejector 45 to compress the drag pyrolysis vapor stream to a sufficient pressure to flow into the condenser 30 in line 49. The liquid jet ejector 45 is connected to the overhead drag line 44 extending from an overhead of the drag pyrolysis reactor 50. The liquid jet ejector 45 is also in downstream communication with a bottoms line 22 of the condenser 30. The liquid jet ejector 45 compresses the drag pyrolysis vapor stream with the pyrolysis oil stream, so it may flow into the condenser 30 at higher pressure than the drag pyrolysis reactor 42.

In the condenser, the drag pyrolysis vapor stream in line 49 and the pyrolysis vapor stream in line 18 are condensed to liquid pyrolysis oil which is recovered in the condenser bottoms line 22. A product liquid pyrolysis oil stream is taken in a product line 29 from the pyrolysis oil stream in the condenser bottoms line 22. A product pyrolysis vapor stream may be taken in vapor product stream in line 34 from the pyrolysis oil stream in the condenser overhead. In an aspect, the vapor product stream in line 34 may comprise C1-C30 hydrocarbons.

The use of the liquid jet ejector 45 provides benefits for the reliability of the process and apparatus. It is static equipment, so it can be machined from any metallurgy and does not have any delicate or fouling-prone components found in compressors, such as mechanical seals, pulsation dampeners, or check valves. The liquid jet ejector 45 also cools the drag pyrolysis vapor stream in line 44 that it compresses by contacting the drag pyrolysis vapor steam with the cooler motive liquid in the slip stream in line 46. The total heat of compression as well as much of the heat developed in the drag pyrolysis reactor 42 is absorbed by the sensible heat capacity of the slip stream in line 46. The drag pyrolysis vapor stream in the overhead line 44 leaving the drag pyrolysis reactor 42 is prone to fouling due to the high temperature and its composition, so a compression step integrated with cooling is more desirable than adding another heat exchanger to cool the drag pyrolysis vapor stream.

EXAMPLE

A simulation study for recovering a liquid product stream from a waste plastic feed was performed. The results including the various streams, their composition and the process parameters are shown in the Table below.

TABLE

| Stream | Mass flow rate (kg/hr.) | Phase | Temp. (° C.) | Pressure kPa (g) | Composition, mass % $C_{1-30}$ hydrocarbons | $C_{31}$+ hydrocarbons | char solids | plastic |
|---|---|---|---|---|---|---|---|---|
| Plastic Feed (11) | 3750 | solid | 31 | 28 | 0 | 0 | 0 | 100 |
| Drag stream (40) | 602 | liquid-solid | 415 | 49 | 1 | 49 | 50 | 0 |
| Pyrolysis vapor stream (18) | 3026 | vapor | 415 | 15 | 98 | 2 | 0 | 0 |
| Spray stream (28) | 14119 | liquid | 121 | 1634 | 97 | 3 | 0 | 0 |
| Dried char stream (43) | 324 | solid | 60 | 0 | 0 | 0 | 100 | 0 |
| Drag pyrolysis vapor stream (44) | 293 | vapor | 494 | 0 | 100 | 0 | 0 | 0 |
| Slip stream (46) | 10750 | liquid | 121 | 1634 | 97 | 3 | 0 | 0 |
| Drag pyrolysis vapor stream (49) | 11086 | liquid-vapor | 135 | 13 | 97 | 3 | 0 | 0 |
| Product liquid pyrolysis stream (29) | 2100 | liquid | 121 | 1634 | 97 | 3 | 0 | 0 |
| Vapor product stream (34) | 1276 | vapor | 178 | 14 | 100 | 0 | 0 | 0 |

The results demonstrated the conversion of the drag stream 40 into the valuable product liquid pyrolysis stream in line 29 and vapor product stream in line 34.

SPECIFIC EMBODIMENTS

While the following is described in conjunction with specific embodiments, it will be understood that this description is intended to illustrate and not limit the scope of the preceding description and the appended claims.

A first embodiment of the disclosure is a process for recovering a product pyrolysis oil stream from a waste plastic feedstock comprising pyrolyzing the waste plastic feedstock in a pyrolysis reactor to produce a pyrolysis vapor stream and a drag stream comprising char in a polymer oil; and pyrolyzing the drag stream to convert the polymer oil to provide a drag pyrolysis vapor stream and dried char. An embodiment of the disclosure is one, any or all of prior embodiments in this paragraph up through the first embodiment in this paragraph further comprising passing the pyrolysis vapor stream to a condenser and recovering from the condenser a product pyrolysis oil stream. An embodiment of the disclosure is one, any or all of prior embodiments in this paragraph up through the first embodiment in this paragraph further comprising passing the drag pyrolysis vapor stream to the condenser. An embodiment of the disclosure is one, any or all of prior embodiments in this paragraph up through the first embodiment in this paragraph further comprising separating the pyrolysis vapor stream in the condenser to recover the vapor product stream and a liquid pyrolysis oil stream. An embodiment of the disclosure is one, any or all of prior embodiments in this paragraph up through the first embodiment in this paragraph wherein a portion of the liquid pyrolysis oil stream is recycled to the condenser to contact the pyrolysis vapor stream. An embodiment of the disclosure is one, any or all of prior embodiments in this paragraph up through the first embodiment in this paragraph wherein the liquid pyrolysis oil stream is recovered from a bottom of the condenser. An embodiment of the disclosure is one, any or all of prior embodiments in this paragraph up through the first embodiment in this paragraph wherein the drag stream is pyrolyzed in a rotary calciner. An embodiment of the disclosure is one, any or all of prior embodiments in this paragraph up through the first embodiment in this paragraph further comprising feeding the drag stream to one end of the rotary kiln and discharging the dried char and the drag pyrolysis vapor stream from the other end of the rotary calciner. An embodiment of the disclosure is one, any or all of prior embodiments in this paragraph up through the first embodiment in this paragraph further comprising feeding the drag pyrolysis vapor stream into the condenser from a liquid jet ejector. An embodiment of the disclosure is one, any or all of prior embodiments in this paragraph up through the first embodiment in this paragraph further comprising compressing the drag pyrolysis vapor stream with the liquid pyrolysis oil stream. An embodiment of the disclosure is one, any or all of prior embodiments in this paragraph up through the first embodiment in this paragraph wherein the condenser comprises a spray distributor for spraying the recycle liquid pyrolysis oil stream into the pyrolysis vapor stream.

A second embodiment of the disclosure is an apparatus comprising a pyrolysis reactor to produce a pyrolysis vapor stream and a drag stream; a drag pyrolysis reactor in downstream communication with a drag line extending from a bottom of the pyrolysis reactor; a condenser in downstream communication with the drag pyrolysis reactor. An embodiment of the disclosure is one, any or all of prior embodiments in this paragraph up through the second embodiment in this paragraph wherein the drag pyrolysis reactor is a rotary calciner with one end connected to the drag line and the condenser in downstream communication with another end of the rotary calciner. An embodiment of the disclosure is one, any or all of prior embodiments in this paragraph up through the second embodiment in this paragraph in which a liquid jet ejector is connected to an overhead line extending from an overhead of the drag pyrolysis reactor and in communication with a bottoms line of the condenser for compressing the drag pyrolysis vapor stream with a pyrolysis oil stream so it may flow into the condenser. An embodiment of the disclosure is one, any or all of prior embodiments in this paragraph up through the second embodiment in this paragraph wherein the condenser is in downstream communication with an overhead line extending from an overhead of the pyrolysis reactor.

A third embodiment of the disclosure is a process for recovering a pyrolysis oil stream from a waste plastic feedstock comprising pyrolyzing the waste plastic feedstock in a pyrolysis reactor to produce a pyrolysis vapor stream and a drag stream comprising char in polymer oil; pyrolyzing the drag stream to convert the polymer oil to provide a drag pyrolysis vapor stream and dried char; and condensing the pyrolysis vapor stream and the drag pyrolysis vapor stream to provide a liquid pyrolysis oil stream. An embodiment of the disclosure is one, any or all of prior embodiments in this paragraph up through the third embodiment in this paragraph wherein the drag stream is pyrolyzed in a rotary kiln. An embodiment of the disclosure is one, any or all of prior embodiments in this paragraph up through the third embodiment in this paragraph further comprising feeding the drag stream to one end of the rotary kiln and discharging the dried char and the drag pyrolysis vapor stream from the other end of the rotary kiln. An embodiment of the disclosure is one, any or all of prior embodiments in this paragraph up through the third embodiment in this paragraph further comprising injecting the drag pyrolysis vapor stream into the contact condenser through a liquid jet ejector. An embodiment of the disclosure is one, any or all of prior embodiments in this paragraph up through the third embodiment in this paragraph further comprising compressing the drag pyrolysis vapor stream into the contact condenser with the liquid pyrolysis oil stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for recovering a product pyrolysis oil stream from a waste plastic feedstock comprising:

pyrolyzing the waste plastic feedstock in a pyrolysis reactor to produce a pyrolysis vapor stream and a drag stream comprising char in a polymer oil; and pyrolyzing the drag stream to convert the polymer oil to provide a drag pyrolysis vapor stream and dried char.

2. The process of claim 1 further comprising passing the pyrolysis vapor stream to a condenser and recovering from the condenser a product pyrolysis oil stream.

3. The process of claim 1 further comprising passing the drag pyrolysis vapor stream to the condenser.

4. The process of claim 1 further comprising separating the pyrolysis vapor stream in the condenser to recover the vapor product stream and a liquid pyrolysis oil stream.

5. The process of claim 3 wherein a portion of the liquid pyrolysis oil stream is recycled to the condenser to contact the pyrolysis vapor stream.

6. The process of claim 4 wherein the liquid pyrolysis oil stream is recovered from a bottom of the condenser.

7. The process of claim 1 wherein the drag stream is pyrolyzed in a rotary calciner.

8. The process of claim 7 further comprising feeding the drag stream to one end of the rotary kiln and discharging the dried char and the drag pyrolysis vapor stream from the other end of the rotary calciner.

9. The process of claim 4 further comprising feeding the drag pyrolysis vapor stream into the condenser from a liquid jet ejector.

10. The process of claim 9 further comprising compressing the drag pyrolysis vapor stream with the liquid pyrolysis oil stream.

11. The process of claim 9 wherein the condenser comprises a spray distributor for spraying the recycle liquid pyrolysis oil stream into the pyrolysis vapor stream.

12. An apparatus comprising: a pyrolysis reactor to produce a pyrolysis vapor stream and a drag stream; a drag pyrolysis reactor in downstream communication with a drag line extending from a bottom of said pyrolysis reactor; and a condenser in downstream communication with said drag pyrolysis reactor wherein the drag pyrolysis reactor is a rotary calciner having a rotating shell.

13. The apparatus of claim 12 in which a liquid jet ejector is connected to an overhead line extending from an overhead of said drag pyrolysis reactor and in communication with a bottoms line of said condenser for compressing the drag pyrolysis vapor stream with a pyrolysis oil stream so it may flow into the condenser.

14. The apparatus of claim 12 wherein the condenser is in downstream communication with an overhead line extending from an overhead of said pyrolysis reactor.

15. A process for recovering a pyrolysis oil stream from a waste plastic feedstock comprising:

pyrolyzing the waste plastic feedstock in a pyrolysis reactor to produce a pyrolysis vapor stream and a drag stream comprising char in polymer oil;

pyrolyzing the drag stream to convert the polymer oil to provide a drag pyrolysis vapor stream and dried char; and condensing the pyrolysis vapor stream and the drag pyrolysis vapor stream to provide a liquid pyrolysis oil stream.

16. The process of claim 15 wherein the drag stream is pyrolyzed in a rotary kiln.

17. The process of claim 16 further comprising feeding the drag stream to one end of the rotary kiln and discharging the dried char and the drag pyrolysis vapor stream from the other end of the rotary kiln.

18. The process of claim 17 further comprising injecting the drag pyrolysis vapor stream into the contact condenser through a liquid jet ejector.

19. The process of claim 18 further comprising compressing the drag pyrolysis vapor stream into the contact condenser with the liquid pyrolysis oil stream.

* * * * *